US006293424B1

(12) United States Patent
Love

(10) Patent No.: US 6,293,424 B1
(45) Date of Patent: Sep. 25, 2001

(54) DISPENSER FOR PULL TAB TICKETS AND OTHER ARTICLES AND A PULL TAB TICKET AND ARTICLE THEREFOR

(75) Inventor: Richard A. Love, Wheatland, PA (US)

(73) Assignee: TKO Technologies Corp., Wheatland, PA (US)

( * ) Notice: Subject to any disclaimer, the term of this patent is extended or adjusted under 35 U.S.C. 154(b) by 0 days.

(21) Appl. No.: 09/312,810

(22) Filed: May 17, 1999

(51) Int. Cl.[7] ..... G07F 11/54; B42D 15/04

(52) U.S. Cl. ..... 221/4; 221/26; 221/121; 221/240; 221/312 A; 283/106; 283/903

(58) Field of Search ..... 211/25, 26, 38, 211/121, 122, 213, 214, 215, 216, 240, 277, 312 A, 197, 198, 4; 283/103, 106, 903

(56) References Cited

U.S. PATENT DOCUMENTS 748,795 * 1/1904 Scheble ..... 221/26
3,051,286 * 8/1962 Stange et al. ..... 221/240 X
5,056,684 * 10/1991 Beach et al. ..... 221/198 X
5,529,208 * 6/1996 Carstens et al. ..... 221/1
5,921,547 * 7/1999 Wilner ..... 273/139

* cited by examiner

*Primary Examiner*—F. J. Bartuska
(74) *Attorney, Agent, or Firm*—Quirk & Tratos

(57) ABSTRACT

A device for dispensing pull tab tickets, lottery tickets and other articles and the articles to be dispensed thereby are set forth. The device includes one or more carousels removably retaining magazines containing tickets to be dispensed. The carousels are indexed to position a magazine for dispensing the article. After the patron has paid for the ticket, a dispensing mechanism pulls the article from the magazine and dispenses it. Each article has at its margin a slot which cooperates with a rod in the magazine to hold the articles in the magazine. When dispensed, the article is pulled from the rod.

19 Claims, 7 Drawing Sheets

DISPENSER FOR PULL TAB TICKETS AND OTHER ARTICLES AND A PULL TAB TICKET AND ARTICLE THEREFOR

FIELD OF THE INVENTION

The present invention relates to devices for dispensing pull tab gaming tickets and other tickets or articles adapted to be retained and dispensed by such devices.

BACKGROUND

Pull tab tickets according to the prior art are used for gaming and entertainment. In the usual fashion, a merchant buys an inventory of tickets and retains them in a jar or other container. Patrons buy the tickets and open them to reveal the outcome for the ticket. The outcome may be a combination of symbols, e.g. cherries, 7's or "bar" symbols of the type found in slot machines. The outcome may also be a number or series of numbers. For the game to which the tickets pertain there is a pay schedule for the outcomes, i.e. two cherries win five dollars, or winning numbers are posted. If the outcome of the ticket matches a winning outcome, the establishment pays the player the indicated amount. If the outcome is a losing outcome, the ticket is a loser and the purchaser receives no prize. The schedule of prizes or awards is designed, for the number of tickets printed and sold for the game, to provide the establishment with a profit.

The individual tickets are fashioned from paper and are rectangular. A portion of the ticket is printed with the outcome (or number). To conceal the outcome portion of the ticket, that portion is folded over on itself to form a folded bundle. The bundle is then secured by a burstable band. When the ticket is purchased, the band is bursted and the bundle unfolded to reveal the outcome. The portion of the ticket extending from the bundle, may be printed with serial numbers or other material to identify the ticket and the game.

As can be appreciated, it is important to conceal the outcome prior to the purchase of the ticket.

Some types of tickets may arrange several tickets together, fold-bundle them and, with a single band, secure the bundle. When the band is bursted, the tickets are unfolded to reveal multiple outcomes. "Tickets" will hereinafter be used to refer to either single or multiple outcome tickets.

Aside for the issue of security, it can further be appreciated that retaining the tickets in a jar or container can subject them to theft. Stolen tickets represent a loss or revenues for the game to the establishment. There is a need for a device which can prevent theft.

A further consideration is that in some jurisdictions where pull tab tickets are legal require the establishment to offer tickets for two different games. These games may, for example, offer different prizes. Thus the need for security is heightened by the need to secure two sets of tickets prior to sale.

There is also a need for a device which can automatically accept payment for a ticket and dispense a ticket without the intervention of establishment employees. Again, when tickets are sold but the payment is not remitted to the establishment, i.e. the establishment employee pockets the money, the establishment loses profit related to the game. Further, employees attend to their normal duties without having to sell tickets and collect the money therefor.

A need exist for a device which can automatically dispense pull tab tickets, which can dispense several different types of such articles such as different game pull tab tickets, different debit cards, lottery tickets or a combination thereof, which provides for security and a pull tab ticket adapted to be so dispensed. There is also a need for a device which can keep a running tally of money received, tickets sold and the like.

SUMMARY OF THE INVENTION

There is, therefore, set forth according to the present invention a device for dispensing a pull tab ticket which provides for security for the unsold tickets and which automatically accepts payment for and dispenses the tickets. Also set forth is a device which can dispense tickets for different games and which can generate and store data concerning the sales of tickets.

Toward this end, the device includes a closed housing having a discharge opening. A magazine is disposed in the housing, the magazine having a ticket mounting rod. Each ticket has a body with a fold-bundled portion containing the printed outcome. At a margin of the body is a deformable slot extending to a bore which is adapted to deform to remove the ticket from the rod. Accordingly the tickets are stacked along and retained by the rod with the rod passing through the bores thereof. A dispenser is disposed in the housing and, when actuated, engages a ticket to pull it from the rod, the slot deforming to pull the ticket from the rod. Preferably the dispenser includes a finger which engages the fold-bundle to urge it from the rod and carry the ticket to the discharge for dispensing thereof. Means are included for accepting payment such a bill validator, coin acceptor credit or debit card acceptor or the like. Upon receipt of payment the dispenser is actuated to dispense a ticket.

The device may mount a plurality of magazines on a rotatable carousel to offer different tickets or to provide for a greater inventory of tickets for sale. Means are provided for indexing the carousel to position a magazine containing tickets at the dispenser for dispensing thereof. Multiple carousels may be provided.

Instead of providing carousels, the tickets may be contained in one or more magazines. The magazines would be arranged in a row. In this instance the dispenser would be linearly indexed to the magazines or alternatively the magazines would be indexed to the dispenser to dispense tickets from the magazines. Further each magazine could have associated therewith a dedicated dispenser. As hereinafter described, the term carousel shall be interpreted to mean either a round carousel or a linear carousel.

Additionally the dispenser and carousels may be under control of a processor which receives signals from the payment acceptance means and which controls the actuation of the dispenser and indexing of the carousel(s). Further, sensors may be provided to sense whether the magazine at the dispenser is empty. The processor may further include a data structure to store data indicating the payments received and the tickets dispensed which data may be downloaded and for tracking and accounting purposes.

Also set forth according to the present invention is a ticket for the dispenser includes the deformable slot and bore to releasably retain the tickets on the rod in the magazine.

The magazine for the rod may be generally closed. Full magazines may be exchanged for empty magazines to change or refill the supply of game tickets.

While the present invention is directed to pull tab tickets it is also adapted to dispense other articles such as debit cards, lottery tickets and the like.

Accordingly, the device and ticket according to the present invention provides an integrated system for offering and dispensing pull tab tickets and other articles. The device provides security by housing the tickets as well as providing the system for dispensing the thickets. The tickets or other articles, in turn, are adapted to be releasably retained in a stacked relationship for dispensing thereof. Multiple games may be provided by use of one or more carousels. Games may be introduced quickly and easily by providing new magazines of tickets.

BRIEF DESCRIPTION OF THE DRAWINGS

These and other features and advantages of the present invention will become better appreciated with reference to the specification, claims and drawings wherein:

DESCRIPTION

Figure 1:
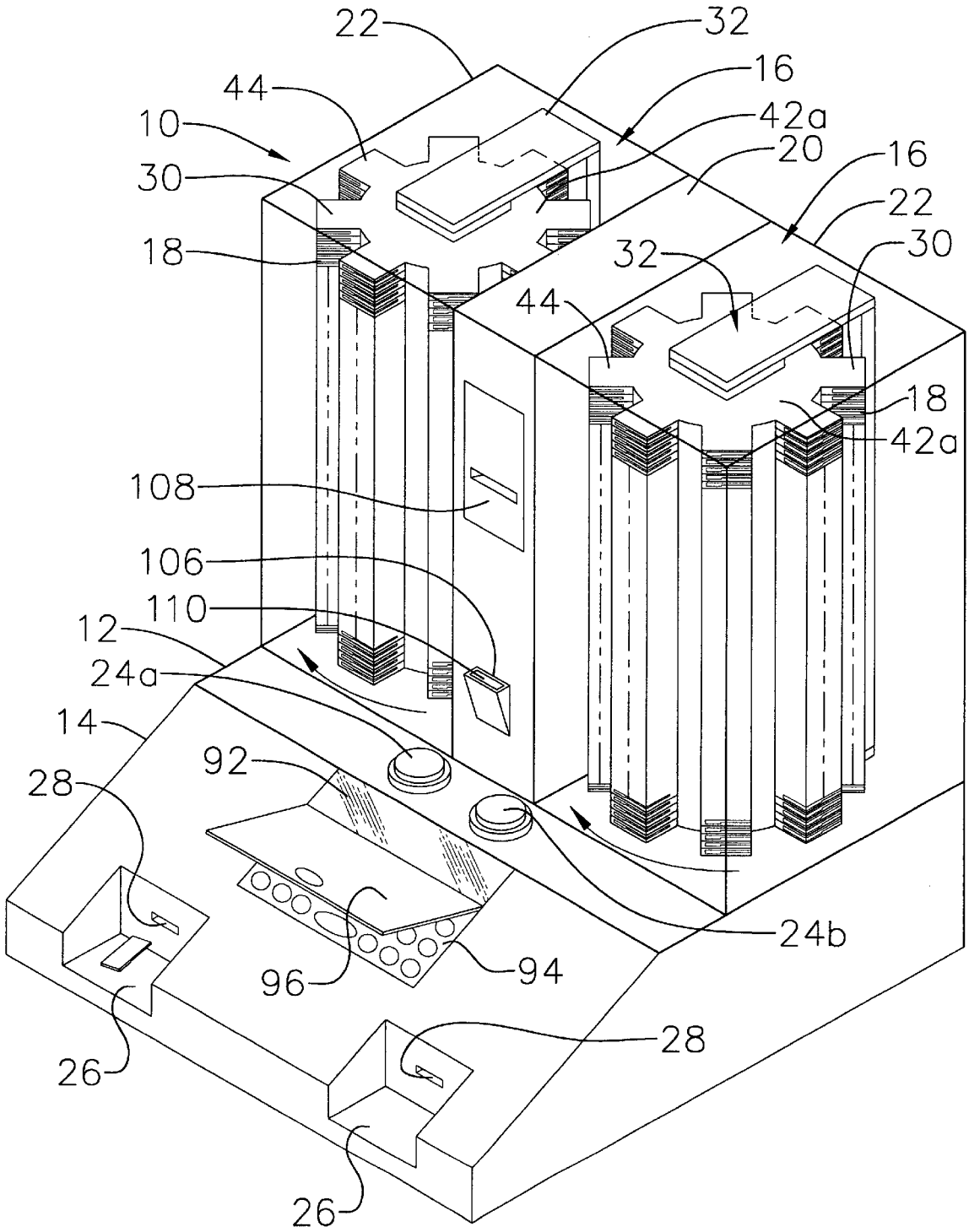
FIG. 1 is a top, front perspective view of a device according the present invention.
Figure 2:
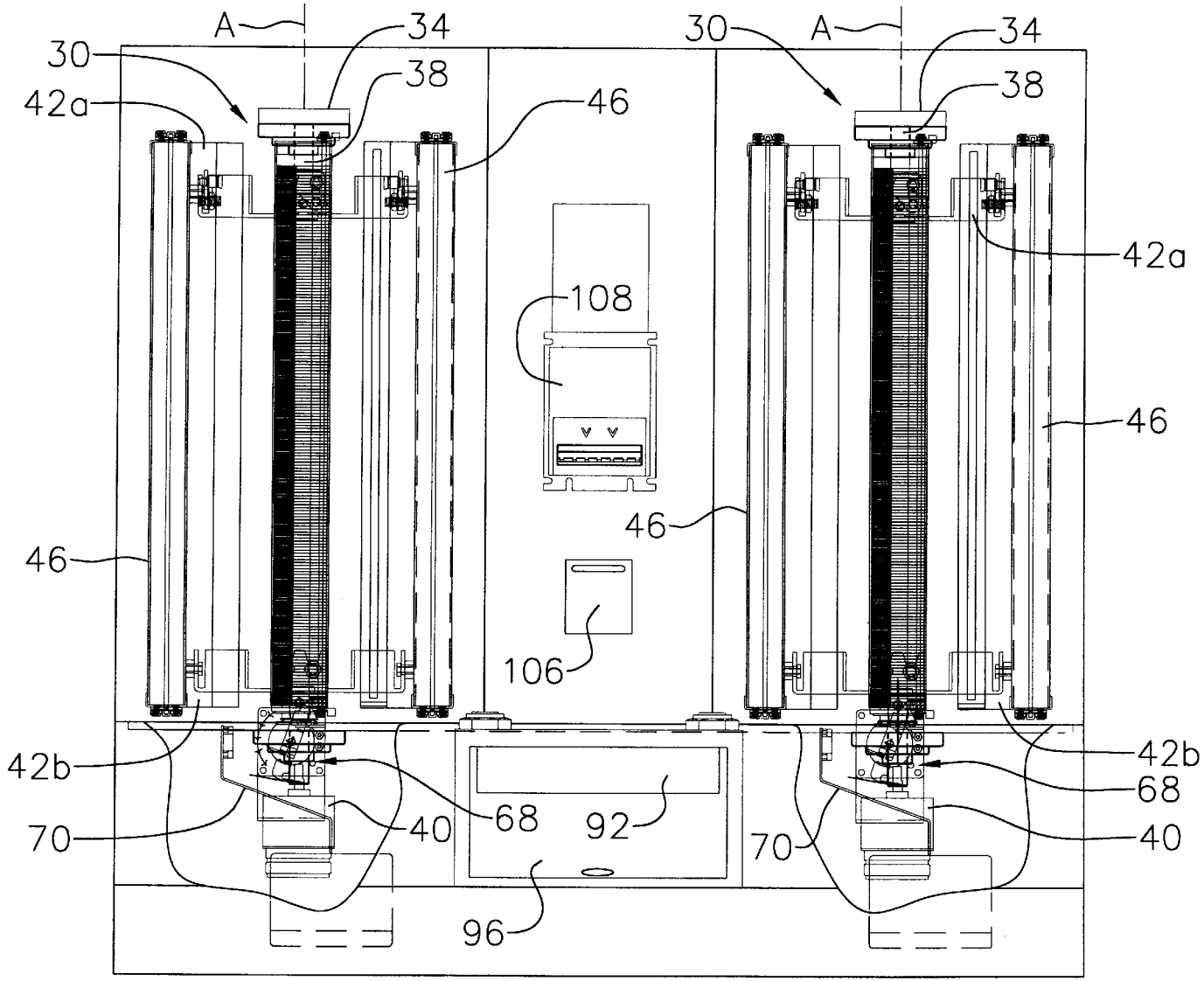
FIG. 2 is a partially broken, front view of the device of FIG. 1.
Figure 3:
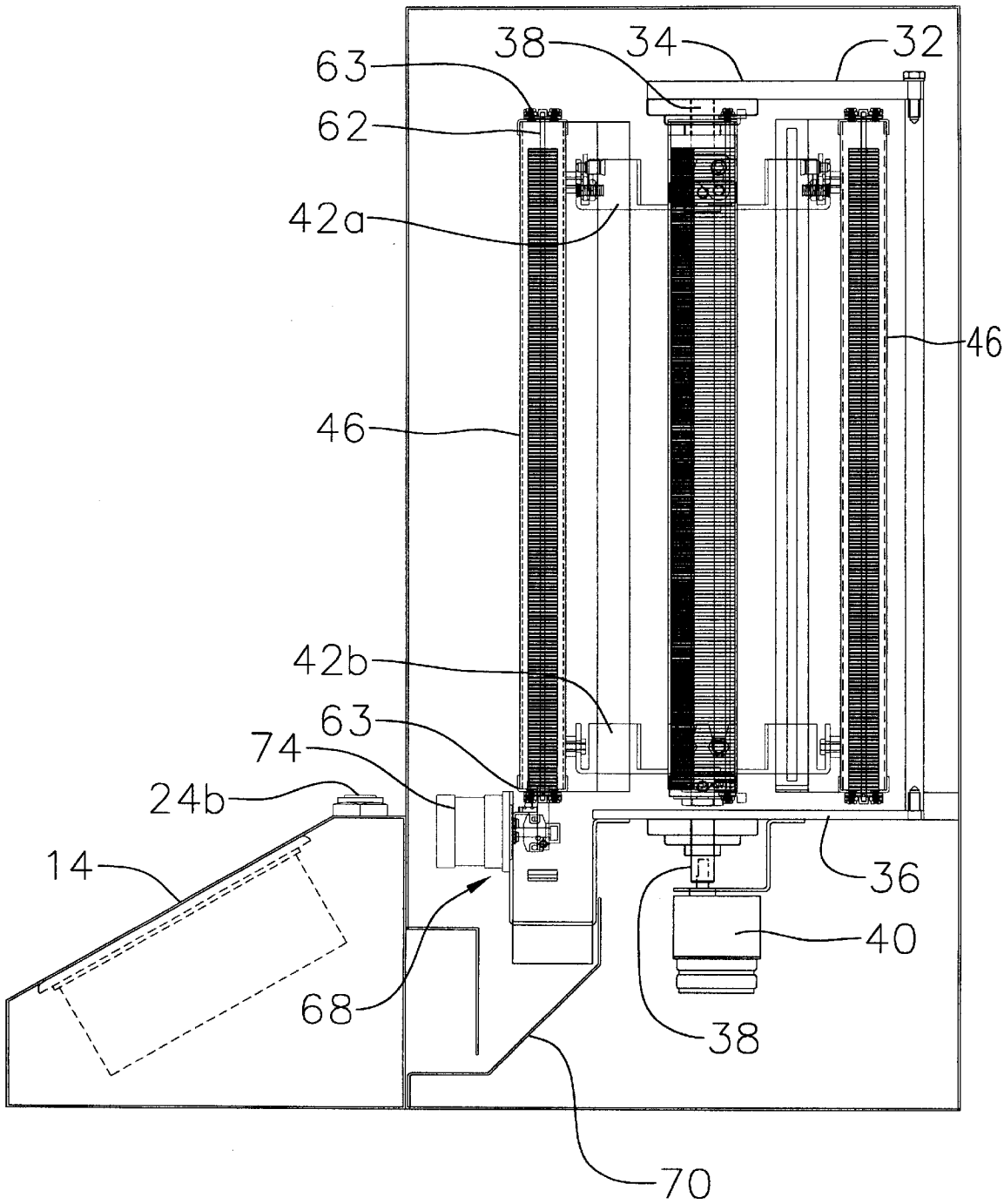
FIG. 3 is a partially broken, side view of the device of FIG. 1.

Turning to FIGS. 1–3, a device 10 according to the present invention is shown for dispensing pull tab tickets and other articles. The device 10 includes a housing 12 having a base 14 which contains a controller processor (not shown) to control the operation of the device. The housing 12 contains and displays one or more carousel mechanisms 16 each, in turn, mounting articles such as pull tab tickets 18 in a manner described below. As shown in the drawings, the device 10 illustrated has a pair of carousel mechanisms 16 which may be separated by a partition 20 which, in combination with the base 14 may support transparent enclosures 22 for the carousel mechanisms 16. The enclosures 22 may be removable or otherwise able to be opened to gain access to the carousel mechanisms 16. Locks are provided on the enclosures to prevent unauthorized opening of the enclosures 22.

The base 14 is generally flat defining a case for the controlling processor and carousel mechanism drive means as hereinafter described. Disposed on the base 14 are a pair of selector buttons 24*a,b* by which a patron controls the carousel mechanisms 16 for selection of a ticket 18 to purchase. At the front of a base 14 are one or more trays 26 each disposed about a discharge opening 28 through which a purchased ticket 18 is dispensed by the device 10 for acceptance by the patron.

With continued reference to FIGS. 1–3, each carousel mechanism 16 includes a rotatable carousel 30 adapted to rotate about an axis A. Each carousel 30 is supported by a support frame 32 having an upper member 34 to support and journal the top of the carousel 30 and a lower support plate 36 to likewise journal and support the bottom of the carousel 30. A shaft 38 mounts the carousel 30 for rotation between the upper member 34 and support plate 36.

As shown in FIG. 3, the shaft 38 is, in turn, coupled to the shaft of a stepper motor 40 adapted to, under control of the control processor, index the carousel 30 to position the desired ticket 18 for dispensing. As shown in FIGS. 1–3 and 5, at the upper and lower ends of each carousel 30 are upper and lower supports, 42*a,b* each presenting eight projecting support wings 44 adapted to releasably mount a ticket magazine 46. As shown in the drawings, each carousel 30 has eight magazines 46. Thus it can be appreciated that under the control of the stepper motor 40 each carousel 30 may be indexed to position the magazines 46 at a position for dispensing of a ticket from the magazine 46 as hereinafter described.

Figure 6A:
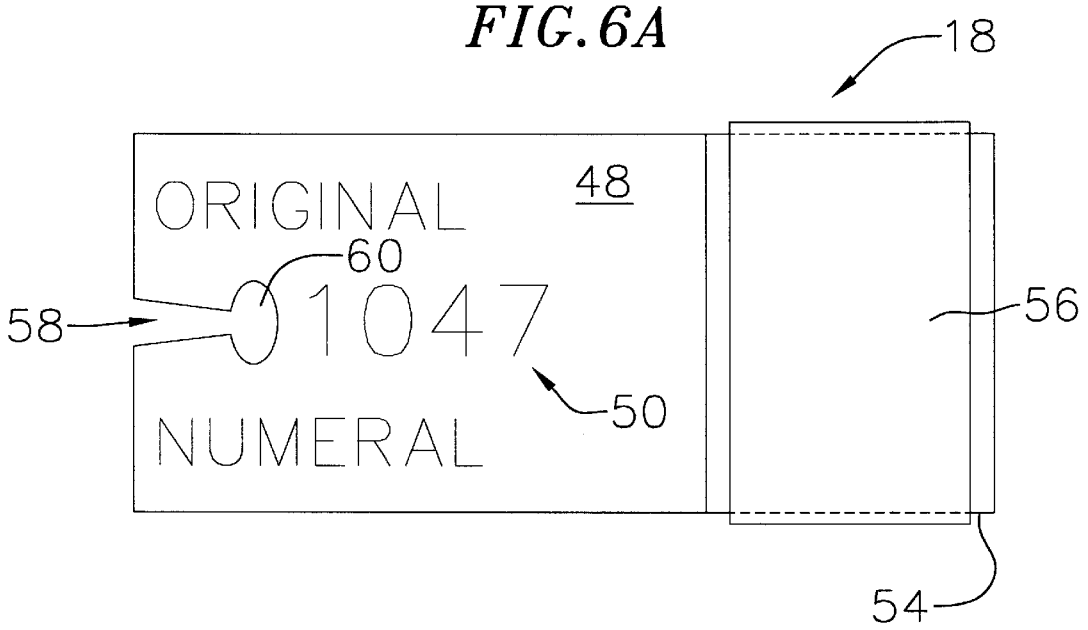
FIG. 6A is a top view of a bundle of pull tab tickets adapted to be dispensed by the device according to the present invention.
Figure 6B:
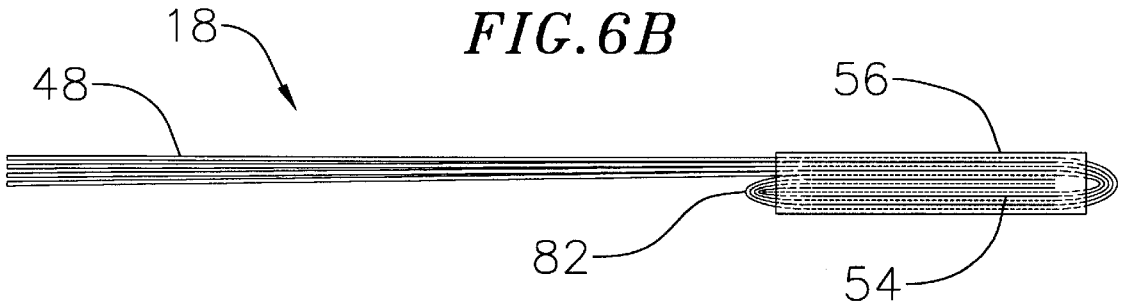
FIG. 6B is a side section view of the bundle of FIG. 6A.
Figure 6C:
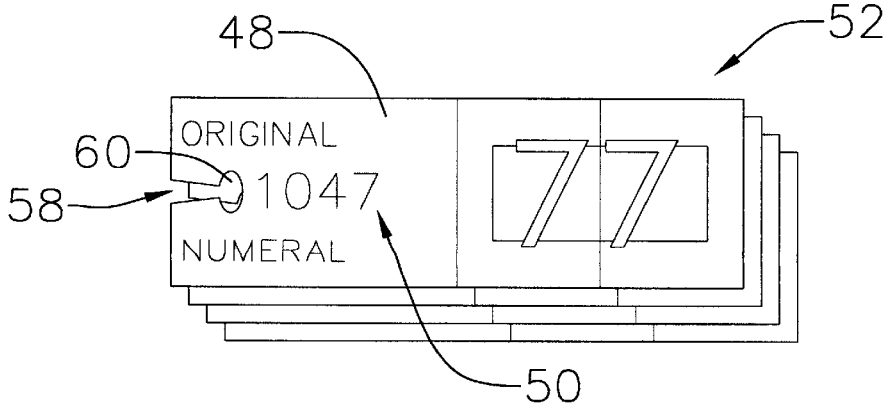
FIG. 6C illustrates the opening of the ticket bundle of FIG. 6A to reveal an outcome.

With reference to FIGS. 6A–C, an example of a ticket 18 adapted to be dispensed by the device 10 is shown. While the ticket 18 is shown in FIGS. 6A–C comprises a bundle of four tickets each adapted to produce an outcome, it is to be understood that a single outcome ticket, bundles of 3–5 tickets or other ticket bundles or other articles such as credit cards, lottery tickets or the like could likewise be dispensed by the device 10.

The ticket 18 is printed in a known fashion including a control number portion 48 imprinted with a control number 50 which is used by the manufacturer of the ticket to verify the authenticity of the ticket 18. Also on the control number portion 48, while not shown on the drawings, may be printing or illustrations to describe and identify the game to which the tickets 18 apply. Each of the tickets 18 also includes an outcome portion 52 printed with the outcome of the ticket 18 pertaining to the game. As shown in the drawings, the outcome may be in the fashion of a slot machine with "7's," numbers, symbols or other indicia to define either a winning or losing outcome for each ticket 18.

To conceal the outcome of the tickets 18 prior to purchase, the outcome portion 52 is folded over upon itself to define a bundle 54 which is retained and made secure by a burstable paper band 56.

Each ticket 18 also includes at an end margin thereof, such as at the control number portion 48, a deformable slot 58 which terminates at a hole 60. As will hereinafter be described, the slot 58 is deformable to permit the tickets 18 to be releasably retained in the carousel magazine 46.

As shown in FIGS. 1–4B, each magazine 46 may be embodied as an elongated enclosure supported at its ends by the upper member 34 and support plate 36. Each magazine 46 also provides support for a rod 62 extending the length of the length of the magazine 46 and having a diameter to be closely received through the holes 60 of the tickets 18 whereby a stack of tickets 18 may be releasably mounted along each rod 62. As will hereinafter be described, when a ticket 18 is to dispensed, it is pulled from its supporting rod 62 deforming the slot 58 to pass the ticket 18 from the rod 62. Prior to dispensing, the tickets 18 are retained within the magazine 46 in a stacked relationship by the rod 62 passing through their holes 60. Each magazine 46 has sidewalls 64*a,b* and a rear wall 66 to confine and support the tickets in the aforesaid stacked relationship.

The tickets 18 are initially disposed in the magazine 46 along the rod 62 and retained in temporary and secure packaging. When the tickets 18 are to be loaded into a magazine 46, the enclosure 22 is opened and the ticket-depleted magazine 46 is removed therefrom. The magazine 46 is releasably retained to the carousel 30 by retainers 63 (FIG. 3) disposed at the upper and lower supports 42*a,b*. The replacement magazine 46 containing the stack of tickets 18 is removed from its packaging and the magazine 46 is positioned to be captured by the retainers 63. When the magazine 46 with the tickets 18 is positioned the enclosure 22 is closed and locked.

Each of the carousels 30 may mount tickets 18 for various games. For example, up to eight different games may be provided on each carousel 30; however, to maintain a large inventory of tickets 18 to be dispensed, only one game may be offered by each carousel 30 thereby allocating eight magazines 46 of tickets 18 for each game for each carousel 30. Furthermore, the transparent enclosures 22 enable the patron to view the inventory of tickets 18 available for purchase and to assure, as described below, that the desired ticket 18 for the desired game is available.

As stated above, the shaft 38 for each carousel 30 is coupled to a stepper motor 40 adapted to rotate each carousel 30, for example, in a clockwise rotation as indicated by the arrows in FIG. 1. The stepper motor 40 is controlled by the controller processor disposed in the base 14 to index the carousels 30 for dispensing of the patrons' ticket 18.

Figure 4B:
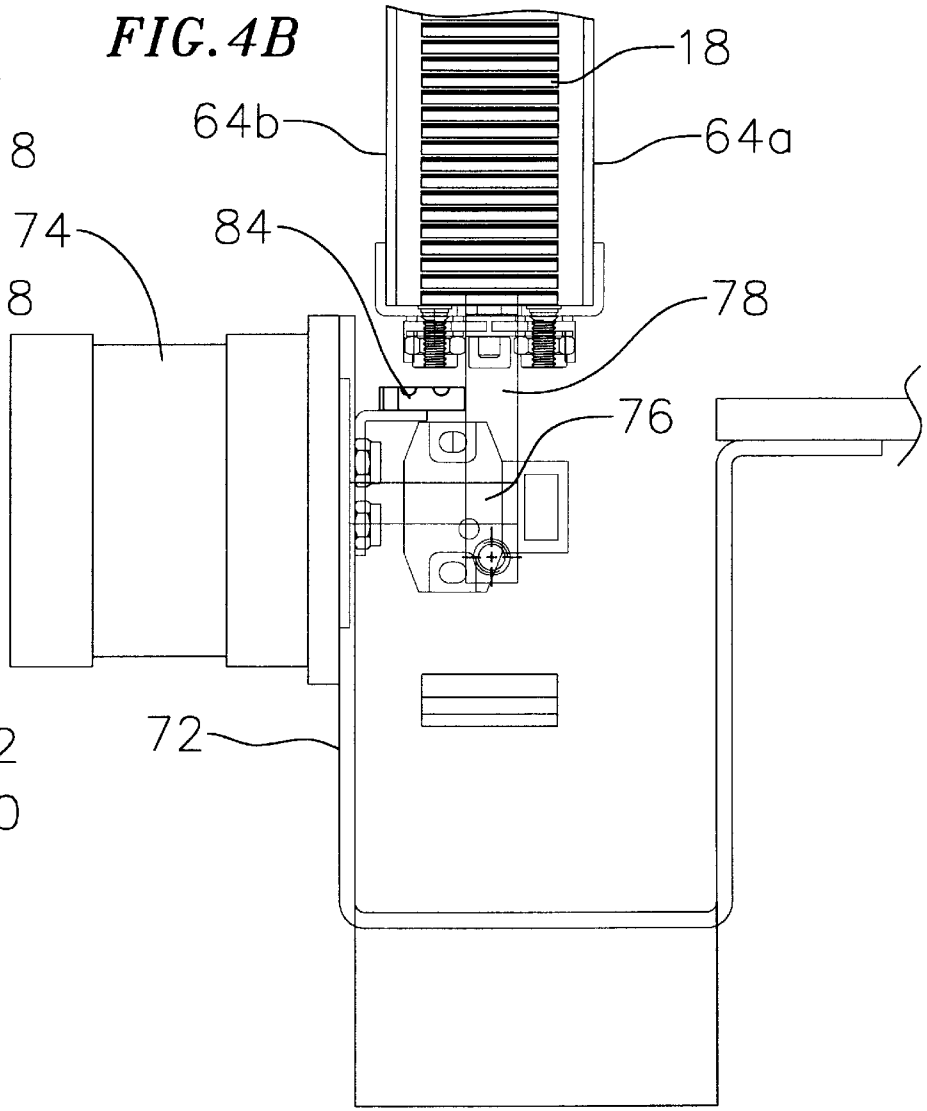
FIG. 4B is a front section view of the dispensing mechanism of FIG. 4A.
Figure 4A:
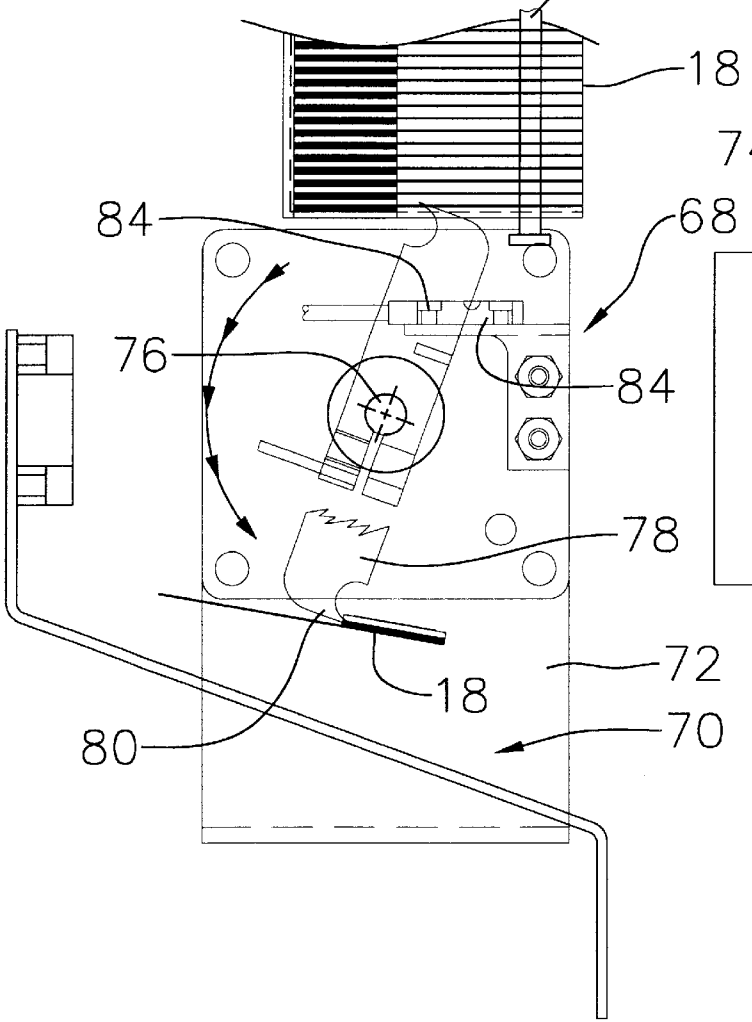
FIG. 4A is a side section view of a portion of the mechanism for dispensing tickets.
Figure 5:
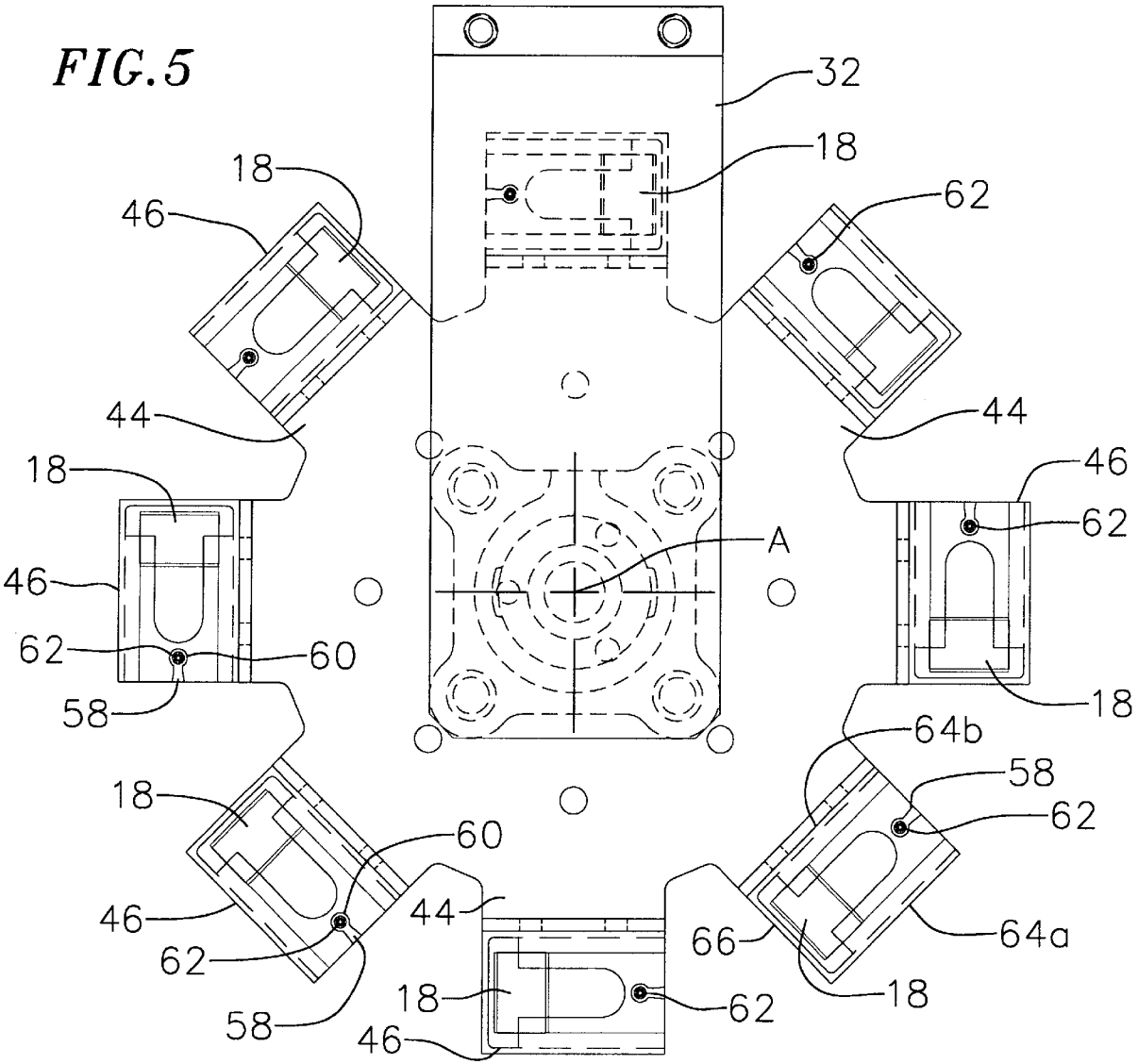
FIG. 5 is a top view of a carousel for the device of FIG. 1.

To dispense the tickets 18 from the magazines 46, each carousel 30 has associated therewith a dispensing mechanism 68 as shown in FIGS. 4A,B. The dispensing mechanism 68 is disposed below each carousel 30 and has associated therewith a chute 70 through which a dispensed ticket 18 travels to the appropriate discharge opening 28. A support bracket 72 supports a motor 74 having a shaft 76 mounting a dispensing arm 78. The arm 78 has at each end a finger 80 adapted to engage the bundle 54 of a ticket 18 to be dispensed and pull the ticket 18 from the rod 62. As shown in FIG. 4A, the removed ticket 18 is transported approximately 180 degrees from the magazine 46 whereat it falls from the finger 80 into the chute 70 and from the discharge opening 28. With reference to FIG. 6B, the finger 80 engages the ticket 18 at edge 82 of the bundle 54 to provide for pulling of ticket 18 from the rod 62. When the ticket 18 is engaged by the finger 80, the force of the rotation of the motor 74 urges the slot 58 of the ticket 18 to deform to pull the ticket 18 from the rod 62 removing the ticket from the magazine 46. As shown in FIG. 4B, the arm 78 and finger 80 may have a lateral dimension such that the finger 80 has a wide surface to engage the edge 82 to transmit the force of the motor 74 thereto. Sensors 84, which may be optical or magnetic, sense the position of the arm 78 to provide feedback for control of the motor 74 and the position of the arm 78. Further, optical or other sensors 105 may be disposed in the chute 70 or proximate the bottom of the magazine 46 to provide a signal that the magazine 46 at the dispensing mechanism 68 is empty. If the sensors 105 sense that a magazine 46 is empty of tickets 18, the signal to the processor from the sensors 105 removes this magazine 46 from the inventory of magazine available to dispense tickets 18 and to index to, for example, an adjacent magazine 46.

Figure 7:
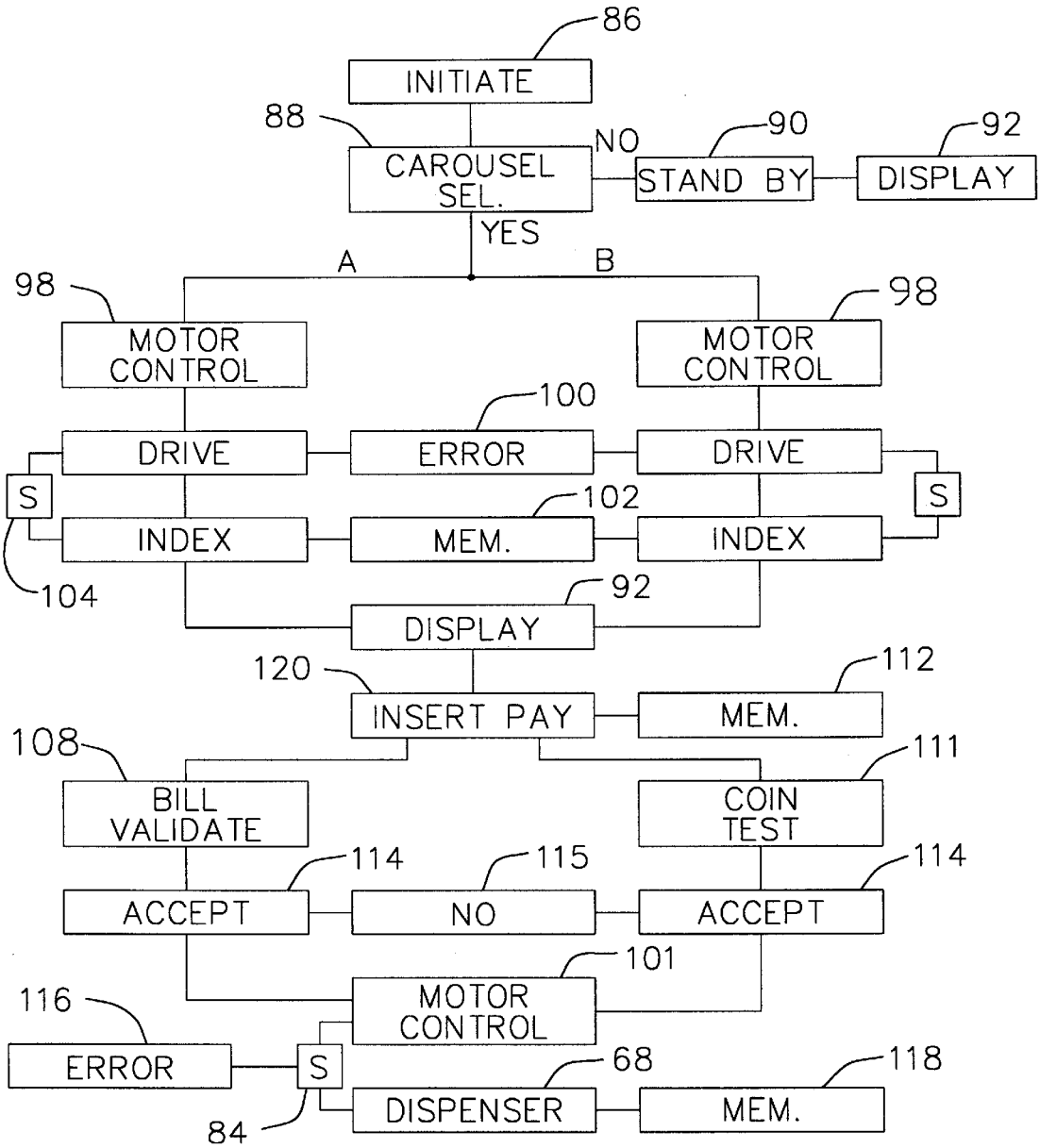
FIG. 7 is a logic diagram of the operation of the device according to the present invention.

With reference to FIG. 7 and FIG. 1, the operation of the device 10 will now be described.

At step 86 the controller processor for the device 10 is initiated by providing power thereto. At step 88 the processor determines whether or not a patron is attempting to select a carousel for dispensing of a ticket 18 by operating one of the selector buttons 24*a,b* or whether the device 10 should be placed in a standby mode. In a standby mode, as indicated by step 90, the processor may control the device 10 to drive a display 92 on the base 14 to display graphic or printed information such as to advertise the various games which are being offered by the device 10, provide instructions as to how to purchase a ticket 18 or provide other information, advertising or instruction. The display 92 may be a plasma display, video screen or the like. With reference to FIG. 1 associated with the display 92 there may be included a key board 94 having various control keys to provide input into the device controller/processor to identify the magazine 46 at which certain game tickets 18 are being dispensed, to control the display 92 to provide other advertising and to retrieve data which may be stored in the processor's memory as hereinafter described. The control panel 94 is covered by a locking door 96 to prevent unauthorized access thereto.

If a patron desires to purchase a ticket 18, they press the selector buttons 24*a,b* to select the carousel 30 containing tickets for the desired game (or the desired articles). As illustrated in FIG. 7, under the control of the selector buttons 24*a,b* (branch A or B in FIG. 7), the processor/controller controls at 98 the stepper motor 40 to drive and randomly index the selected carousel 30 to position the magazine 46 containing the desired ticket 18 at the dispensing mechanism 68. As shown in FIG. 7, the motor control 98 controls the stepper motor 40 to rotate and drive the shaft 38 for the selected carousel 30. If there is a problem in driving a stepper motor 60, an error message at 100 is generated. The indexing of the stepper motor 40 is controlled to randomly select a magazine 46 from the selected carousel 30. If a carousel 30 has been determined to be empty a memory 102 of the processor which identifies the position of each magazine 46 and the game to which the magazine's tickets 18 pertain may store the position of the empty magazine(s) and index to magazines 46 containing tickets. Alternatively, a magazine 46 may be randomly selected and if it is determined to be empty, the carousel 30 would be instructed to index to an adjacent magazine 46 until one with tickets available is located at the dispensing mechanism 68. A sensor 104 senses the position of the drive of the carousels 30 to provide a feedback for positioning for the carousels 30 in the desired manner. As the carousels 30 are indexed, the processor may drive the display 92 to display information pertaining to the corresponding game including identifying the game, pay schedules, ticket prices and the like. When the carousel 30 has positioned the magazine 46 containing the tickets 18 for the desired game, as confirmed by viewing the ticket stack of the magazine 46 through the enclosure 22 and any message which may be displayed at the display 92, the patron inserts payment for the desired ticket 18. At step 120 the patron inserts consideration for the ticket 18 to be purchase as by inserting coins in a coin acceptor 106 or a cash validator 108. The coin acceptor 106 has a slot 110 through which coins are inserted and a suitable coin tester (not shown) to test the authenticity of the coin. A return slot (not shown) is provided to return unaccepted coins. The cash validator 108 is of known construction. The coin acceptor 106 and cash validator 108 provide signals at 114 to the controller processor indicating that consideration has been accepted. If the coin or cash is not accepted at 115 a signal is sent to the display 92 to inform the patron that the consideration has not been accepted. After the patron has inserted the consideration to purchase the ticket 18, the acceptance of the consideration may be stored at 112 in the processor's memory to provide a tally of the amount of money received by the device 10, time of receipt, the game to which the ticket pertains or the like. If the consideration is accepted, the motor 74 for the dispensing mechanism 68 is actuated by the processor at 101 to rotate through a cycle such that the arm 78 rotates approximately 180 degrees for removing the desired ticket 18 from the magazine 46 and depositing it into the chute 70. Sensors 84 provide feedback signals to confirm the operation of the arm 78 and motor 74 and if the motor 74 fails to rotate or a problem is detected, an error message at 116 is generated at the display 92. The dispensed ticket 18 drops through the chute 70 and from the discharge opening 28 as shown in FIG. 1.

Should the operator of the device 10 desire to confirm the performance of the device 10 through the control panel 94, they may access the processor's memory to display at the display 92 the desired information or download into a portable memory the data concerning the acceptance of payment and the dispensing of tickets 18 such as the number of tickets 18 sold for a game or the like.

While I have shown and described certain embodiments of the present invention, it is to be understood that it is subject to many modifications and changes without departing from the scope of the appended claims.

I claim:

1. A dispenser and pull tab combination comprising:

said pull tab includes a body having a fold-bundled segment and at a margin thereof spaced from the segment a slot extending to a bore;

a rod adapted to be closely received through the bore to releasably mount a plurality of tabs in a stacked relationship;

a housing having a discharge opening, said rod disposed in said housing;

a dispenser having a finger to engage a tab and release it from the rod for discharge through said discharge opening; and means for actuating said dispenser.

2. The combination of claim 1 further including a carousel to mount a plurality of rods and means for indexing the carousel to register tabs with said dispenser.

3. The combination of claim 2 wherein said pull tab is rectangular including at one margin said bundle and at the opposite margin said slot and bore.

4. The combination of claim 2 wherein said indexing means includes a carousel drive motor coupled to said carousel for driving rotation thereof, means for sensing the angular position of the carousel and a carousel drive motor controller to control the positioning of the carousel.

5. The combination of claim 4 further including means for prompting the carousel drive motor controller to select between the tabs to be dispensed.

6. The combination of claim 1 wherein said dispenser includes a dispenser drive motor mounting said finger, means for sensing the position of said finger and a dispenser drive motor controller for controlling the dispenser drive motor to dispense a single tab.

7. The combination of claim 1 further including means for sensing the dispensing of a tab.

8. The combination of claim 1 further including means for accepting payment for the dispense of a tab and means for actuating the dispenser in response to said payment accepting means receiving payment for the tab.

9. The combination of claim 8 including at least one of a currency bill validator and coin acceptor, each adapted to issue a signal in response to receiving payment for a tab to acuate said dispenser.

10. A pull tab ticket adapted to be stacked with like tickets along a rod comprising:

a body having a fold-bundled segment concealing the outcome for the ticket;

a burstable band securing said segment; and at a margin a slot extending to a bore adapted to closely pass said rod, said slot adapted to deform to pass the rod when the ticket is removed from the rod for dispensing thereof.

11. The ticket of claim 10 wherein said ticket is rectangular including said bundle and said slot at opposite margins.

12. A dispenser and pull tab ticket combination comprising:

a closed housing having a discharge opening;

a magazine disposed in the housing, said magazine having a ticket mounting rod;

each ticket including at a margin a slot extending to a bore adapted to closely pass said rod, said tickets stacked along said rod;

a data processor;

a dispenser including a dispenser motor controlled by the processor to rotate a shaft and a finger disposed on the shaft to engage a ticket on the rod, remove it from the rod and direct it to the discharge in response to rotation of the shaft; and means for accepting payment for the ticket and issuing a signal in response thereto to said processor, said processor adapted to control the dispenser motor to urge the finger to remove a ticket from the rod in response to receipt of said signal from the accepting means.

13. The combination of claim 12 wherein said magazine includes at least side walls to retain said stacked tickets in alignment along said rod.

14. The combination of claim 13 wherein said magazine is defined by a closed receptacle having an open end to dispense said tickets.

15. The combination of claim 14 wherein said rod is secured in the receptacle.

16. The combination of claim 12 including a carousel mounting a plurality of rods, a carousel drive to rotate the carousel to index each rod with the dispenser and an actuator adapted to issue a signal, said processor adapted to control said carousel drive to index said rods in response to signals from said actuator.

17. The combination of claim 16 including a plurality of carousels each mounting a plurality of rods.

18. The combination of claim 12 including a sensor to sense the position of the finger and issue signals in response thereto to said processor.

19. The combination of claim 12 including a sensor to sense that a ticket has been dispensed and in response thereto issue a data signal to said processor.

* * * * *